US010176792B1

(12) United States Patent
Elzinga et al.

(10) Patent No.: US 10,176,792 B1
(45) Date of Patent: Jan. 8, 2019

(54) AUDIO CANCELING OF AUDIO GENERATED FROM NEARBY AERIAL VEHICLES

(71) Applicant: Amazon Technologies, Inc., Seattle, WA (US)

(72) Inventors: Michael John Elzinga, Woodinville, WA (US); Scott Michael Wilcox, Kirkland, WA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 14/829,027

(22) Filed: Aug. 18, 2015

(51) Int. Cl.
*G10K 11/175* (2006.01)

(52) U.S. Cl.
CPC .... *G10K 11/175* (2013.01); *G10K 2210/1281* (2013.01)

(58) Field of Classification Search
CPC ..... G10K 11/175–11/1788; G10K 2210/1281; G10K 2210/00–2210/512
See application file for complete search history.

(56) References Cited

U.S. PATENT DOCUMENTS 5,834,647 A * 11/1998 Gaudriot ..... G10K 11/1788 381/71.12
8,059,489 B1 * 11/2011 Lee ..... G01N 29/14 367/136
2009/0190767 A1 * 7/2009 Aaron ..... H03G 3/32 381/57
2012/0237049 A1 * 9/2012 Brown ..... G10K 11/1788 381/71.1
2014/0314245 A1 * 10/2014 Asada ..... G10K 11/1788 381/71.6
2015/0078563 A1 * 3/2015 Robertson ..... G10K 11/1786 381/63
2015/0104026 A1 * 4/2015 Kappus ..... G10K 11/178 381/63
2015/0248640 A1 * 9/2015 Srinivasan ..... G06Q 10/08355 705/338
2015/0302858 A1 * 10/2015 Hearing ..... G10L 19/00 381/58
2017/0011340 A1 * 1/2017 Gabbai ..... G06Q 10/0836

* cited by examiner

*Primary Examiner* — Mark Fischer
(74) *Attorney, Agent, or Firm* — Athorus, PLLC

(57) ABSTRACT

The implementations described include an audio canceling device that receives an unmanned aerial vehicle ("UAV") audio signature representative of audio generated by an unmanned aerial vehicle, monitors audio within an environment in which the audio canceling device is located for audio generated by the UAV, generates an attenuation-signal based on detected audio generated by the UAV, and outputs the attenuation-signal to attenuate the audio generated by the UAV. In one example, the audio canceling device may be used to attenuate audio generated by a UAV that is permeating into a user's home during delivery of an item to the user's home by the UAV.

19 Claims, 7 Drawing Sheets

AUDIO CANCELING OF AUDIO GENERATED FROM NEARBY AERIAL VEHICLES

BACKGROUND

Vehicle traffic around residential areas continues to increase. Historically, vehicle traffic around homes and neighborhoods was primarily limited to automobile traffic. However, the recent development of aerial vehicles, such as unmanned aerial vehicles has resulted in a rise of other forms of vehicle traffic. For example, hobbyists may fly unmanned aerial vehicles in and around neighborhoods, often within a few feet of a home. Likewise, there is discussion of electronic-commerce retailers, and other entities, delivering items directly to a user's home using unmanned aerial vehicles. As a result, such vehicles may be invited to navigate into a backyard, near a front porch, balcony, patio, and/or other locations around the residence to complete delivery of the package.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

Figure 1:
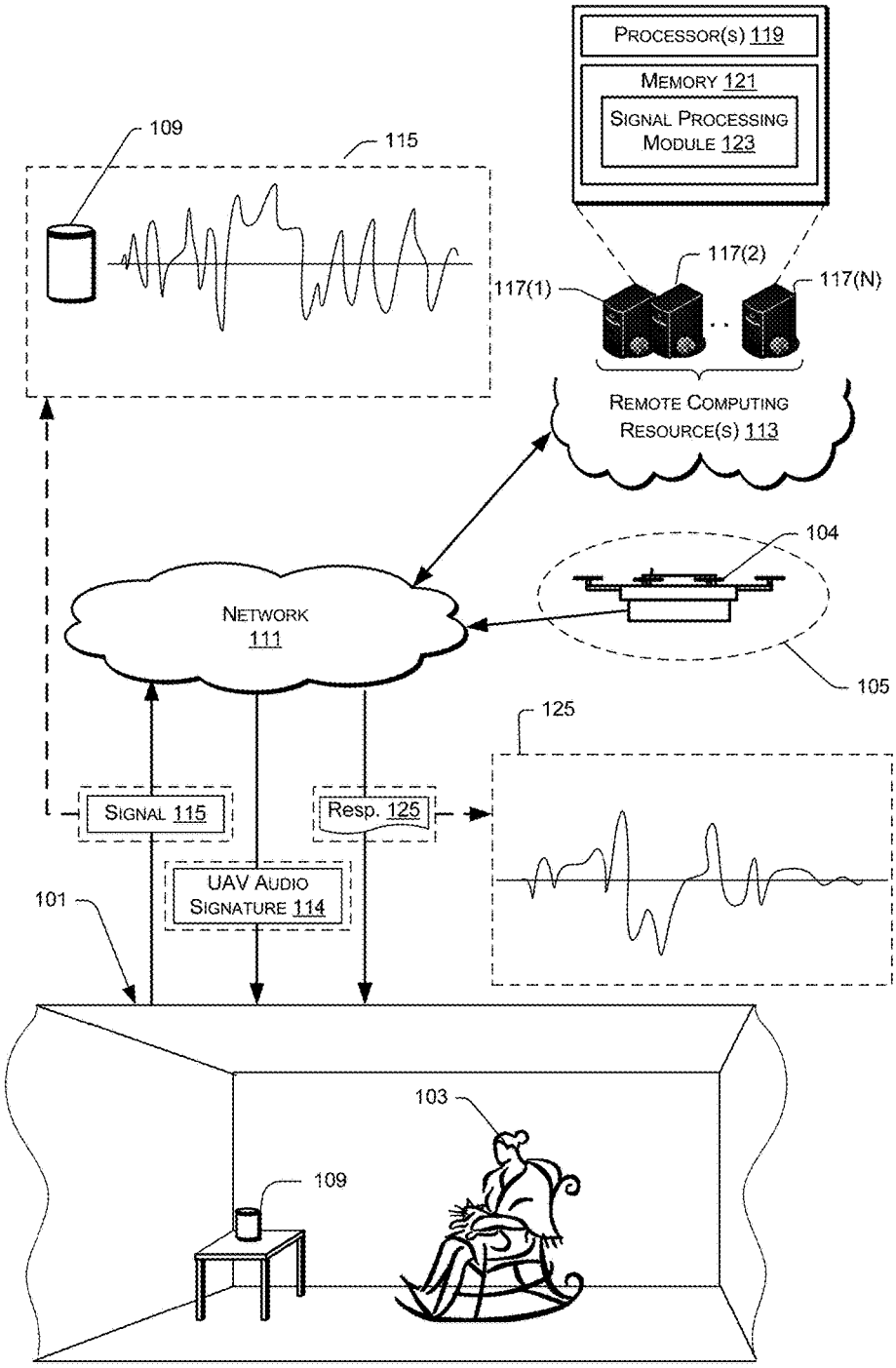
FIG. 1 depicts an example audio canceling computing architecture set in an example home environment.

While implementations are described herein by way of example, those skilled in the art will recognize that the implementations are not limited to the examples or drawings described. It should be understood that the drawings and detailed description thereto are not intended to limit implementations to the particular form disclosed but, on the contrary, the intention is to cover all modifications, equivalents and alternatives falling within the spirit and scope as defined by the appended claims. The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include," "including," and "includes" mean including, but not limited to.

DETAILED DESCRIPTION

This disclosure describes computing devices that receive audio signals from sound waves within an environment, identify audio generated by nearby unmanned aerial vehicles ("UAV"), and generate attenuation-signals to attenuate or cancel out the UAV audio. For example, as a UAV approaches an area that includes an audio canceling device, as described further below, the UAV may notify the audio canceling device that the UAV is approaching and provide an audio signature representative of audio generated by the UAV. In response, the audio canceling device may begin to monitor for audio that is similar to the provided audio signature. Upon detection of audio that is similar to the audio signature, the audio canceling device generates an attenuation-signal by, for example, phase shifting and/or inverting the polarity of the detected audio signal that is similar to the audio signature. That attenuation-signal may then be amplified and a sound wave (attenuation-sound wave) transmitted that is directly proportional to the amplitude of the original sound wave carrying the UAV audio, thereby creating destructive interference.

The transmission of the attenuation-sound wave may be timed so that it arrives at a canceling location (e.g., location of a person) at approximately the same time as the sound wave carrying the audio generated by the UAV. By timing the arrival of the attenuation-sound wave carrying the attenuation-signal to coincide with the arrival of the sound wave carrying the UAV audio signal, the destructive interference will effectively reduce the volume of the UAV audio while leaving other audio intact.

While the examples described below utilize a single audio canceling device, it will be appreciated that multiple audio canceling devices, multiple audio transducers, and/or multiple outputs may be utilized alone or in combination. Each of these audio canceling devices may include one or more audio transducers, such as a microphone, for receiving audio signals and one or more output devices for transmitting audio signals (e.g., speakers). In some examples, the audio canceling devices may include a scenario of multiple audio transducers in close proximity to one another, also known as an audio transducer array, or microphone array.

While the audio canceling devices may be configured to perform relatively basic signal processing on the received audio signals, in some instances, these audio canceling devices might not be equipped with the computational resources necessary for performing certain operations. For instance, the audio canceling devices might not include sufficient computational resources for tracking a user through the environment and/or for determining a canceling location at which a user may be present.

As discussed below, in one implementation, the UAV may communicate directly with audio canceling devices, providing monitoring information. Monitoring information, as used herein, includes information that may be utilized by an audio canceling device to monitor for, detect, and/or attenuate audio generated by a UAV. For example, monitoring information may include one or more of an actual or planned geographic position, altitude, trajectory, velocity, destination, etc., of a UAV, an audio signature representative of audio generated by the UAV, and/or other like information. Alternatively, or in addition thereto, the audio canceling device may receive monitoring information from a remote-computing resource. For example, a remote-computing resource may control the UAV and/or provide the UAV with a flight path that is followed by the UAV. The remote-computing resources may also determine audio canceling devices that are within a defined distance of the flight path and send monitoring information to the audio canceling device.

In addition to attenuating UAV audio generated by nearby UAVs, in some implementations, the audio canceling device may also be configured to provide item delivery information to a user and/or to receive item feedback from the user. For example, when the audio canceling device detects UAV audio, in addition to outputting an attenuation-signal, it may notify a user that the UAV is approaching and that their item will soon be delivered. Likewise, when the UAV departs, the change in the amplitude of the UAV audio is detected by the audio canceling device and the audio canceling device may provide a notification to the user that the item has been delivered and that the UAV has departed.

A user may also provide feedback to the audio canceling device regarding the UAV delivery and/or the delivered item. For example, the audio canceling device may record audio output from the user relating to the delivered item and provide that recorded audio to a remote-computing resource for processing. The remote-computing resource may process the feedback to determine, for example, if UAV delivery plans for that location are to be modified, to determine if item damage for a particular type of item has occurred, etc.

The architecture may be implemented in many ways. One illustrative implementation is described below in which a single audio canceling device is placed within a room. However, the architecture may be implemented in many other contexts and situations. For example, the architecture described with respect to FIG. 1 utilizes an audio canceling device in combination with remote-computing resources. In other implementations, all processing and other aspects described herein may be performed locally on the audio canceling device without use of remote-computing resources.

FIG. 1 shows an illustrative audio canceling computing architecture set in an example environment 101 that includes a user 103 positioned at a canceling location and a nearby UAV 104 positioned at a UAV audio source location 105. The architecture includes an audio canceling device 109 physically situated in a room of the home, but communicatively coupled over a network 111 to remote-computing resources 113, and/or the UAV 104. In the illustrated implementation, the audio canceling device 109, which in this example includes a transducer (e.g., microphone) and an output (e.g., speaker), is positioned on a table within the environment 101. In other implementations, one or both of the transducer or the output may be remote from the audio canceling device. For example, the output may be mounted on a ceiling within the environment 101.

The audio canceling device may be configured in any variety of manners and positioned at any number of locations (e.g., on a table, on walls, in a lamp, beneath a table, under a chair, etc.). For example, an audio canceling device may include all the components in a single unit, or different components may be distributed at different locations and connected via wired or wireless communication. As such, implementations described herein may utilize configurations of audio canceling devices that are different than that described with respect to FIG. 1. In addition, audio canceling devices may have any number of audio transducers and/or outputs. Some audio canceling devices may only include one audio transducer, while others may include multiple audio transducers, which may be configured as part of an audio transducer array.

The audio canceling device 109 may be implemented with or without a haptic input component (e.g., keyboard, keypad, touch screen, joystick, control buttons, etc.) or a display in some instances. In certain implementations, a limited set of one or more haptic input components may be employed (e.g., a dedicated button to initiate a configuration, power on/off, etc.). Nonetheless, in some instances, the primary and potentially only mode of user interaction with the audio canceling device 109 is through voice input and audible output. One example implementation of an audio canceling device 109 is provided below in more detail with reference to FIG. 2.

The audio canceling device 109 communicates with a nearby UAV 104 and/or the remote-computing resources 113 via a network 111. For example, the audio canceling device may receive monitoring information from the UAV 104 and/or the remote-computing resources 113 notifying the audio canceling device 109 to monitor for UAV audio generated by an approaching UAV 104. In some implementations, the monitoring information may include a UAV audio signature 114 that is utilized by the audio canceling device to determine if audio being received by the audio canceling device includes audio generated by the UAV 104.

When monitoring, the audio canceling device 109 receives audio signals from sound waves in the environment 101 that are generated by any variety of sources. After receiving audio sound waves and identifying the UAV audio signal, the audio canceling device 109 may generate an attenuation-signal that will be amplified and transmitted on a sound wave from an output of the audio canceling device and used to effectively reduce the volume of the UAV audio. In some implementations, an output of the attenuation-signal may be timed so that it reaches a canceling location (e.g., location of a user) at approximately the same time as the UAV audio signal.

In addition to attenuating UAV audio signals, in some instances, the audio canceling device 109 may periodically scan the environment 101 to determine the surrounding acoustical environment. For example, when there is no detected audio, or the audio is below a predetermined threshold, the audio canceling device 109 may transmit signals, such as ultrasonic signals, specifically designed to characterize the structures within the environment by modeling their reflection patterns. Based on the reflection patterns, the signals and/or other components of the audio canceling device, such as one or more of the audio transducers, may be adapted to better characterize the environment and receive audio signals from the environment. For example, reflection patterns may be utilized by the audio canceling device 109 to perform a scan to approximate the dimensions of the environment, the location of objects within the environment, and the density of the objects within the environment. In some instances, multiple audio canceling devices within the environment 101 may coordinate or otherwise share information gained from periodic scans of the environment. Such information may be helpful in performing audio cancellation or other functions as described herein. For example, based on reflection patterns, the audio canceling device may identify reflections of UAV audio signals that may reach a user positioned at the canceling location and generate attenuation-signals to attenuate those reflections of UAV audio.

In some instances, the ambient conditions of the room may introduce additional audio signals that form background noise, which increases the difficulty of effectively attenuating UAV audio at a canceling location. In these instances, certain signal processing techniques, such as beamforming, audio source direction and location determination may be utilized in order to detect UAV audio. For example, if the audio canceling device 109 has received a UAV audio signature, it may compare received audio with the audio signature to determine if the received audio includes UAV audio. If detected, the UAV audio may be extracted and an attenuation-signal generated.

In some instances, the audio canceling device 109 might not be equipped with the computational resources required to perform the necessary signal processing to identify the UAV audio and create an attenuation-signal within an acceptable amount of time after receiving the audio. In such instances, the monitoring information may only include a notification to monitor for a UAV by receiving audio and providing the audio to the remote-computing resources 113 for processing. The remote-computing resources 113, upon receiving the audio from the audio canceling device, may perform signal processing on audio signals to identify the UAV audio signal and create an attenuation-signal for use in attenuating the UAV audio.

The remote-computing resources 113 may form a portion of a network-accessible distributed computing platform implemented as a computing infrastructure of processors, storage, software, data access, and other components that is maintained and accessible via a network, such as the Internet. Services offered by the resources 113 do not require end user knowledge of the physical location and configuration of the system that delivers the services. Common expressions associated with distributed computing services include "on-demand computing," "software as a service (SaaS)," "platform computing," "network-accessible platform," "cloud-based platform," "cloud computing" and or other similar terms.

The audio canceling device 109 may communicatively couple to the remote-computing resources 113 and/or the UAV 104 via the network 111, which may represent wired technologies (e.g., wires, USB, fiber optic cable, etc.), wireless technologies (e.g., RF, cellular, satellite, Bluetooth, etc.), and/or other connection technologies. The network 111 carries data, such as audio data, UAV audio signatures, etc., between the audio canceling device 109, the remote-computing resources 113, and/or the UAV.

As illustrated, in this example, the audio signal 115 represents the audio received by an audio transducer of the audio canceling device 109. This audio signal 115 represents the audio signal that contains the UAV audio generated by the UAV 104 and that is used for generating the attenuation-signal, as discussed below.

In addition, the audio canceling device 109 may determine a direction from which the UAV audio is being received, a distance between the transducer of the audio canceling device 109 and the canceling location, such as the location of the user 103, and the distance between the canceling location and the output of the audio canceling device 109, if the output is not included in the audio canceling device 109. For example, through use of a transducer array, the audio canceling device can compute a time offset between audio signals of the UAV audio received by each transducer to determine an approximate location or direction of the UAV audio. A similar technique may be utilized to determine a canceling location when a user 103 at that location communicates with the audio canceling device and/or generates other forms of audio. The location of the output of the audio canceling device 109 may be known (e.g., if it is included in the audio canceling device) and/or can be determined using the same techniques of time offset computation when audio is transmitted from the output.

In order to identify the time offsets between signals received by transducers of the audio canceling device 109, in some instances, the audio canceling device 109 compiles each audio signal received by respective audio transducers and then determines the time offsets between the signals by, for instance, using any time-difference-of-arrival ("TDOA") technique, or any other suitable technique. After identifying the respective time offsets, the audio canceling device 109 can determine a direction and/or source location of the UAV audio.

After detecting the UAV audio, the audio canceling device 109 may transmit that information to the remote-computing resources 113 for signal processing. As illustrated, the remote-computing resources 113 may include one or more servers, such as servers 117(1), 117(2) . . . 117(N). These servers 117(1)-(N) may be arranged in any number of ways, such as server farms, stacks, and the like that are commonly used in data centers. Furthermore, the servers 117(1)-(N) may include one or more processors 119 and memory 121, which may store a signal processing module 123. The signal processing module 123 may be configured, for example, to identify UAV audio included in the received audio signal 115 and generate an attenuation-signal for use in attenuating the UAV audio. In some instances, the signal processing module 123 may use this information to implement beamforming for the audio transducer array within the audio canceling device 109, to provide a response signal 125 back to the environment, and the like. As noted above, the signal processing module 123 may utilize beamforming techniques to focus on audio in a particular area within the environment 101, such as the location of the user 103.

Figure 2:
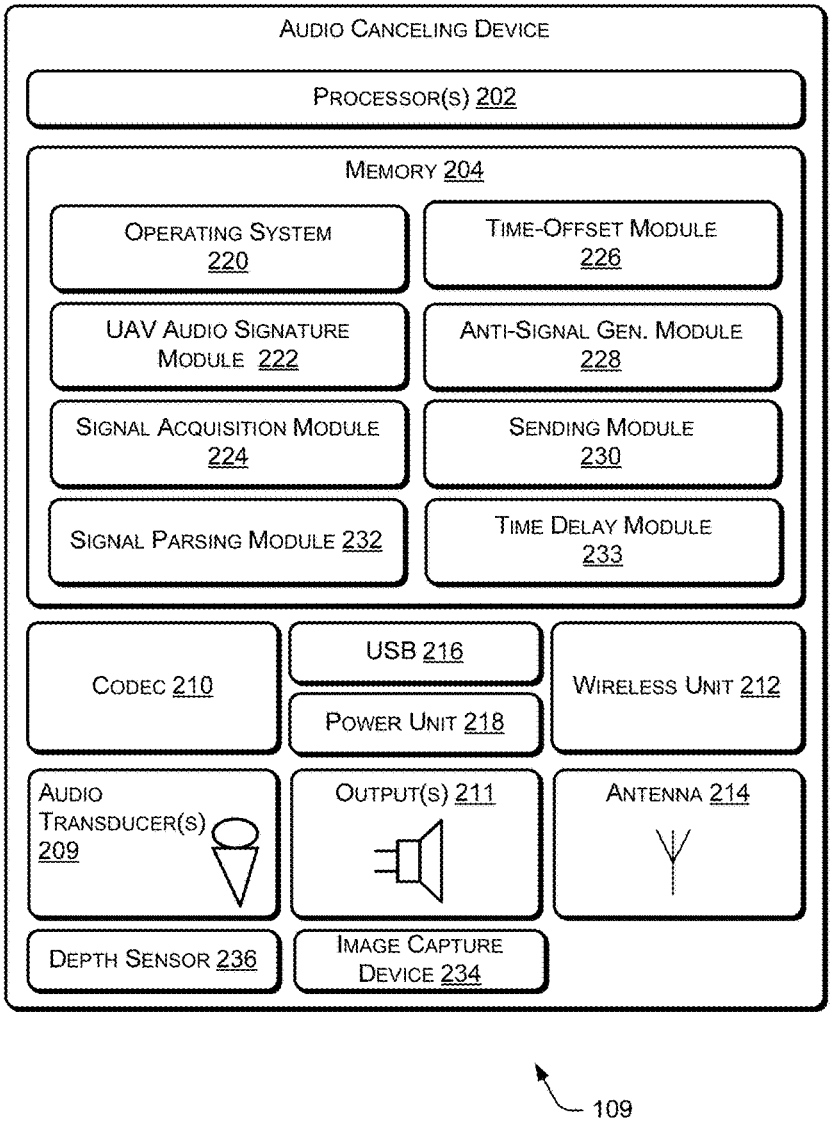
FIG. 2 depicts a block diagram of selected functional components implemented in an example audio canceling device of FIG. 1, according to an implementation.

FIG. 2 shows selected functional components of one audio canceling device 109 in more detail. Generally, the audio canceling device 109 may be implemented as a standalone device that includes a subset of all possible input/output components, memory, and processing capabilities. For instance, the audio canceling device 109 might not include a keyboard, keypad, or other form of mechanical input. The audio canceling device 109 might also not include a display or touch screen to facilitate visual presentation and user touch input. Instead, the audio canceling device 109 may be implemented with the ability to receive and output audio, a network interface (wireless or wire-based), power, and processing/memory capabilities.

In the illustrated implementation, the audio canceling device 109 includes one or more processors 202 and memory 204. The memory 204 (and each memory described herein) may include non-transitory computer-readable storage media ("CRSM"), which may be any available physical media accessible by the processors 202 to execute instructions stored on the memory. In one basic implementation, non-transitory CRSM may include random access memory ("RAM") and Flash memory. In other implementations, non-transitory CRSM may include, but is not limited to, read-only memory ("ROM"), electrically erasable programmable read-only memory ("EEPROM"), or any other medium which can be used to store the desired information and which can be accessed by the processors 202.

The audio canceling device 109 may also include one or more audio transducers 209 for capturing audio within an environment, such as the example environment 101. In some implementations, the audio transducer 209 may take the form of an audio transducer array, such as a microphone array, that includes multiple audio transducers. The audio canceling device 109 may also include one or more outputs 211, such as a speaker, to output audio sounds. A codec 210 may couple to the audio transducer(s) 209 and output 211 to encode and/or decode the audio signals. The codec may convert audio data between analog and digital formats. A user may interact with the audio canceling device 109 by speaking to it, and the audio transducer(s) 209 receives the user speech. The codec 210 encodes the user speech and transfers that audio data to other components. The audio canceling device 109 can communicate back to the user by transmitting audible statements through the output 211. In this manner, the user interacts with the audio canceling device 109 simply through speech, without use of a keyboard or display common to other types of devices.

The audio canceling device 109 may also include a wireless unit 212 coupled to an antenna 214 to facilitate a wireless connection to a network. The wireless unit 212 may implement one or more of various wireless technologies, such as Wi-Fi, Bluetooth, radio frequency ("RF"), near field communication ("NFC"), and/or other wireless technologies.

A USB port 216 may further be provided as part of the audio canceling device 109 to facilitate a wired connection to a network, or a plug-in network device that communicates with other wireless networks. In addition to the USB port 216, or as an alternative thereto, other forms of wired connections may be employed, such as a broadband connection. A power unit 218 is further provided to distribute power to the various components on the audio canceling device 109.

The audio canceling device 109 may be designed to support audio interactions with the user, in the form of receiving voice commands (e.g., words, phrase, sentences, etc.) from the user, capturing audio from within the environment, identifying UAV audio, generating an attenuation-signal for use in canceling out the UAV audio and transmitting the attenuation-signal in a manner to cancel out or reduce the effective volume of the UAV audio at a canceling location. Accordingly, in the illustrated implementation, there are no haptic input devices, such as navigation buttons, keypads, joysticks, keyboards, touch screens, and the like. Further, there is no display for text or graphical output. There may also be a simple light element (e.g., LED) to indicate a state such as, for example, when power is on, when audio canceling is active, and/or when data is being sent or received.

Accordingly, the audio canceling device 109 may be implemented as an aesthetically appealing device with smooth and rounded surfaces, with some apertures for passage of sound waves, and merely having a power cord, or internal charge (e.g., battery) and communication interface (e.g., broadband, USB, Wi-Fi, etc.). Once plugged in, or otherwise powered, the device may automatically self-configure, or with slight aid of the user, and be ready to use. As a result, the audio canceling device 109 may be generally produced at a relatively low cost. In other implementations, other I/O components may be added to this basic model, such as specialty buttons, a keypad, display, and the like.

The memory 204 may store an array of different datastores and/or modules, including an operating system module 220 that is configured to manage hardware and services (e.g., audio transducer, wireless unit, USB, Codec) within and coupled to the audio canceling device 109 for the benefit of other modules. A UAV audio signature module 222 may store and/or provide UAV audio signatures. Likewise, the audio canceling device 109 may include a speech recognition module (not shown) which may provide speech recognition functionality. In some implementations, this functionality may be limited to specific commands that perform fundamental tasks like waking up the device, selecting a user, canceling an input, activating/deactivating audio canceling, and the like. The amount of speech recognition capabilities implemented on the audio canceling device 109 may vary between implementations, but the architecture described herein supports having speech recognition local at the audio canceling device 109. In alternative implementations, all or a portion of speech recognition may be done using remote-computing resources.

The memory 204 may further store a signal acquisition module 224, a time offset module 226, an attenuation-signal generation module 228, a sending module 230, a signal parsing module 232, and a time delay module 233. The signal acquisition module 224 functions to receive signals representing audio signals received by audio transducers of the audio canceling device 109 and optionally from audio transducers of other audio canceling devices within a common environment. For instance, the signal acquisition module 224 may receive the audio signals received by the audio transducer(s) 209 of the audio canceling device 109. Likewise, the signal acquisition module 224 may receive audio signals received by audio transducers of other audio canceling devices. In order to receive signals from other audio canceling devices, the audio canceling devices may couple wirelessly, via a wired network, or the like.

After the audio canceling device 109 receives audio signals, the time offset module 226 may determine a time offset between each signal. The time offset module 226 may utilize a TDOA technique, such as cross-correlation to determine time offsets between the signals received by different transducers or any other technique to determine time offset. The time offset may be used to identify the UAV audio signal location. Similar to speech recognition, determining the UAV audio source location and/or direction may be done locally by the audio canceling device or through use of remote-computing resources.

The signal parsing module 232 may process the audio signal to identify the UAV audio generated by the UAV. For example, the audio canceling device 109 may receive input from the UAV and/or remote-computing resources that indicates a UAV audio signature that is representative of the UAV audio generated by the UAV. The UAV audio signature may be a predefined audio signature that is stored by the UAV audio signature module 222 and/or sent to the audio canceling device. Alternatively, the UAV may record audio at or near the UAV as the UAV is flying and provide that recorded audio to the audio canceling device as the UAV audio signature. With knowledge of the UAV audio signature, the signal parsing module 232 can process the received audio and detect audio signals within the received audio that are similar to the UAV audio signature.

The memory 204 may also include an attenuation-signal generation module 228 and a time delay module 233. The attenuation-signal generation module 228 receives the UAV audio signal and generates an attenuation-signal by, for example, phase shifting, and/or inverting the polarity of the UAV audio signal. The time delay module 233 may be used to determine the UAV audio source location or direction, the canceling location and, if not already known, the location of the transducer 209 and the location of the output 211. As noted above, these locations may be computed using any TDOA technique and/or some of the locations may be known to the audio canceling device. Likewise, the time delay module 233 may compute a time delay that is to elapse before the attenuation-signal is to be sent from an output such that its arrival at the canceling location will coincide with the arrival of the UAV audio.

The speed of sound in air is dependent on the absolute temperature, which directly affects the density of the air. In addition, sound generally propagates through air in an omnidirectional manner. As such, the equation for the speed of sound in air is c=20.05 T (m/s), where T is the absolute temperature of air in degrees Kelvin. At room temperature and standard atmospheric pressure, the speed of sound in air is 343.2 m/s. By utilizing the approximate speed of sound in air of 343.2 m/s and the determined/known locations of the transducer, UAV audio source location and/or direction, output, and canceling location, the time delay module 233 can determine a time delay that is to elapse before sending the attenuation-signal from the output so that the attenuation-signal will arrive at the canceling location at a time that coincides with the arrival of the UAV audio. For example, if the UAV audio source is 100 meters from the canceling location, it will take approximately 0.291 seconds for the UAV audio to travel from the UAV audio source location to the canceling location. Likewise, if the distance between the output and the canceling location is 3 meters, it will take approximately 0.00874 seconds for the attenuation-signal to travel from the output to the canceling location. Finally, if the transducer that receives the UAV audio signal is 4 meters from the UAV audio source location, the UAV audio has already traveled for 0.2797 seconds. The time delay may be computed as the difference between the remaining time before which the UAV audio will arrive at the canceling location and the time during which it will take the attenuation-signal to travel from the output to the canceling location. In this example, the time delay is 0.00256 seconds (0.291 s.–0.2797 s.–0.00874 s).

In some embodiments, after the audio canceling device 109 determines the UAV audio source location and the canceling location, the sending module 230 may send the received audio signal and the location information to the remote-computing resources 113 for further processing. The sending module 230 may package this data together and/or may provide this data over the course of several communications with the remote-computing resources 113.

Alternatively, because the UAV audio generated by the UAV may be repetitive, rather than computing a specific time delay, the audio canceling device may generate an attenuation-signal, begin sending the attenuation-signal, and then monitor the received audio to determine if the amplitude and/or phase of the attenuation-signal is to be altered to improve the attenuation.

A depth sensor 236 may also be included in the audio canceling device 109 that may be used alone or in conjunction with other modules, such as the image capture device 234, to determine the layout of the environment and/or the location of the user (the canceling location). For example, the depth sensor 236 may transmit an infra-red ("IR") signal (or other modulated light output) and measure a time-of-flight for that IR signal. The time-of-flight value may be derived as a function of a time lapsed between transmission of the IR signal and receipt of a returned IR signal that has been reflected by an object within the environment. Alternatively, the time-of-flight value may be derived as a function of the phase difference between the modulated light output and the returned light.

Figure 3:
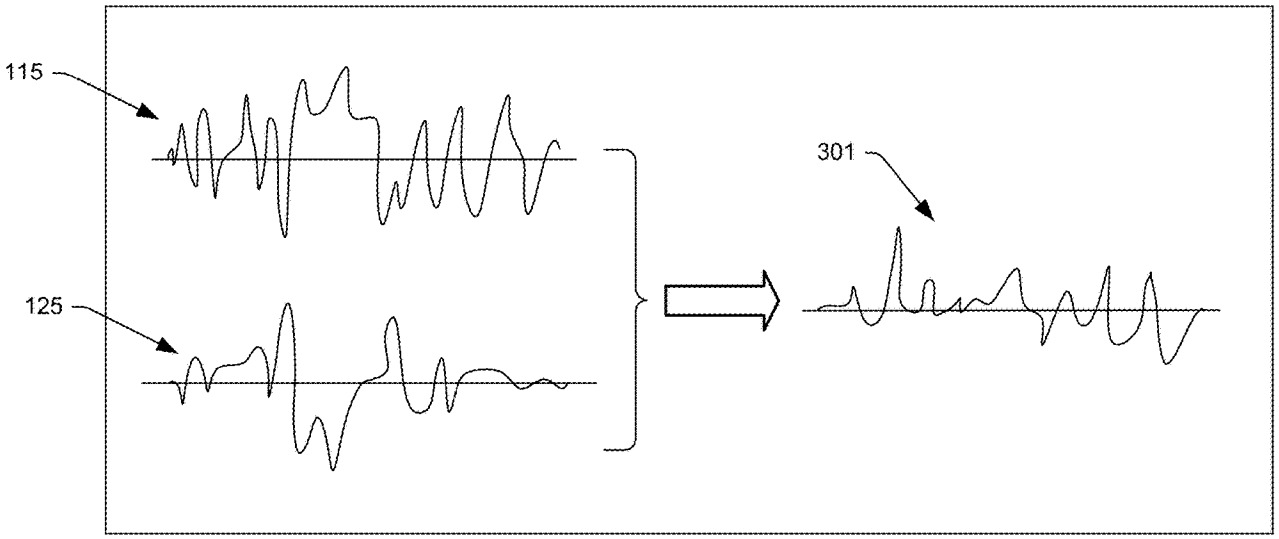
FIG. 3 depicts one possible scenario of combining an audio signal with an attenuation-signal to cancel out audio generated by an unmanned aerial vehicle, according to an implementation.

FIG. 3 depicts one possible scenario of combining a received audio signal with an attenuation-signal to cancel out UAV audio. As discussed above, the audio canceling device 109 utilizes a transducer 209 to receive audio signal 115 within environment 101 and the signal parsing module 232 parses the received audio signal to identify a UAV audio signal based on its similarity to a UAV audio signature. Upon identifying the UAV audio signal, the attenuation-signal generation module 228 generates an attenuation-signal 125 and, optionally, the time delay module 233 determines a time delay that is to elapse before the attenuation-signal is to be sent by the output 211 such that it will arrive at a canceling location at a time that coincides with the arrival of the sound wave carrying the received audio signal 115. As a result of the sound wave carrying the received audio signal 115 and the sound wave carrying the attenuation-signal 125 arriving at the canceling location, the attenuation-signal causes destructive interference and effectively cancels out or lowers the volume of the UAV audio at the canceling location and leaves other audio 301 intact.

Figure 4:
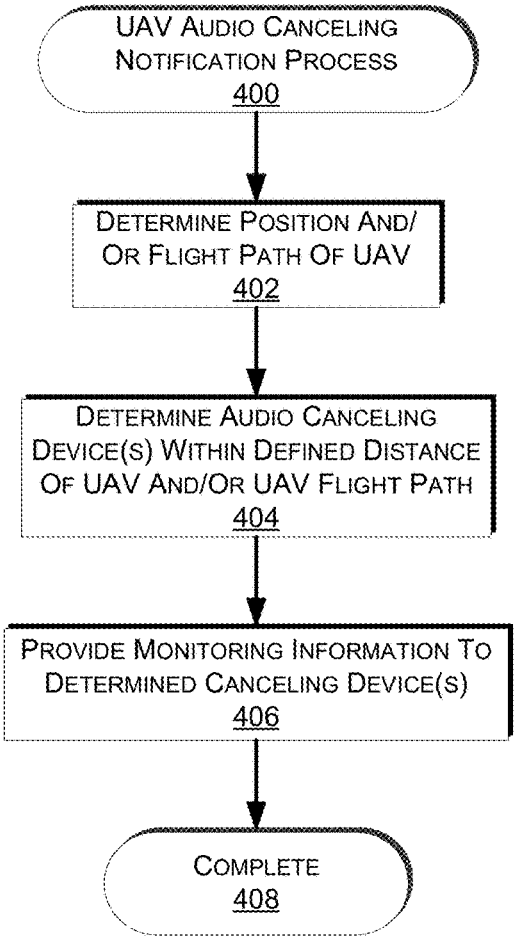
FIG. 4 is a flow diagram illustrating an example unmanned aerial vehicle audio canceling notification process, according to an implementation.

FIG. 4 illustrates a flow diagram of an example UAV audio canceling notification process 400, according to an implementation. This process, and each process described herein, may be implemented by the architectures described herein or by other architectures. The process is illustrated as a series of blocks in a logical flow graph. Some of the blocks represent operations that can be implemented in hardware, software, or a combination thereof. In the context of software, the blocks represent computer-executable instructions stored on one or more computer-readable media that, when executed by one or more processors, perform the recited operations. Generally, computer-executable instructions include routines, programs, objects, components, data structures, and the like that perform particular functions or implement particular abstract data types.

The computer-readable media may include non-transitory computer-readable storage media, which may include hard drives, floppy diskettes, optical disks, CD-ROMs, DVDs, read-only memories (ROMs), random access memories (RAMs), EPROMs, EEPROMs, flash memory, magnetic or optical cards, solid-state memory devices, or other types of storage media suitable for storing electronic instructions. Finally, the order in which the operations are described is not intended to be construed as a limitation, and any number of the described operations can be combined in any order and/or in parallel to implement the process.

The example process 400 may be performed by a UAV and/or by a remote-computing resource that controls, communicates, and/or monitors a UAV. The example process 400 begins by determining a position and/or flight path of a UAV, as in 402. The position and/or flight path of the UAV may identify, for example, the geographic location of the UAV, the altitude of the UAV, the heading of the UAV, the velocity of the UAV, a planned flight path for the UAV, a destination of the UAV, etc.

Based on the position and/or flight path of the UAV, audio canceling devices within a defined distance of the UAV and/or the flight path of the UAV are determined, as in 404. For example, location information, such as an address or location of a user's home that includes an audio canceling device, may be maintained by remote-computing resources for each audio canceling device. Alternatively, the audio canceling devices may include a location determining component that determines the location of the audio canceling device and provides that information to the remote-computing resources and/or the UAV.

The defined distance may be different for different UAVs, different times of year, different weather conditions, etc. The distance may be a direct distance between the UAV and the audio canceling device, factoring in an altitude of the UAV with respect to the audio canceling device. In some implementations, UAVs that generate louder UAV audio may have a larger defined distance than UAVs that generate softer UAV audio. As another example, even though a UAV may be passing directly over a location that includes an audio canceling device, it may be determined that the audio canceling device is not within the defined distance if the UAV is navigating at an altitude such that it cannot be heard from the location of the audio canceling device. In other examples, the defined distance may be decreased in one direction and increased in another depending on the speed and direction of wind. In still another example, the defined distance may vary for different audio canceling devices.

For each audio canceling device determined to be within a defined distance of the UAV, monitoring information is provided to the audio canceling device, as in 406. The monitoring information may include, among other information, information that may be utilized by an audio canceling device to monitor for, detect, and/or attenuate UAV audio generated by a UAV. For example, monitoring information may include one or more of actual or planned geographic position, altitude, trajectory, velocity, destination, etc., of a UAV, an audio signature indicating the UAV audio signature generated by the UAV, an estimated time during which the UAV will be within a defined distance of the audio canceling device, and/or other like information.

After sending the monitoring information to the audio canceling devices determined to be within a defined distance of the UAV and/or the UAV flight path, the example process 400 completes, as in 408.

In some implementations, rather than determining whether audio canceling devices are within a flight path prior to the UAV navigating the flight path, the UAV and/or remote-computing resources may monitor the actual position of the UAV and determine, based on the position of the UAV, whether one or more audio canceling devices are within a defined distance of the UAV. In still another example, the audio canceling devices may emit information, such as a beacon, indicating a location of the audio canceling device. If the UAV detects the emitted information, it may be determined that the audio canceling device is within a defined distance of the UAV and the monitoring information may be transmitted to the audio canceling device. In still another example, the UAV may broadcast monitoring information and, if an audio canceling device receives the broadcast monitoring information, it may be determined that the audio canceling device is within a defined distance of the UAV.

Figure 5:
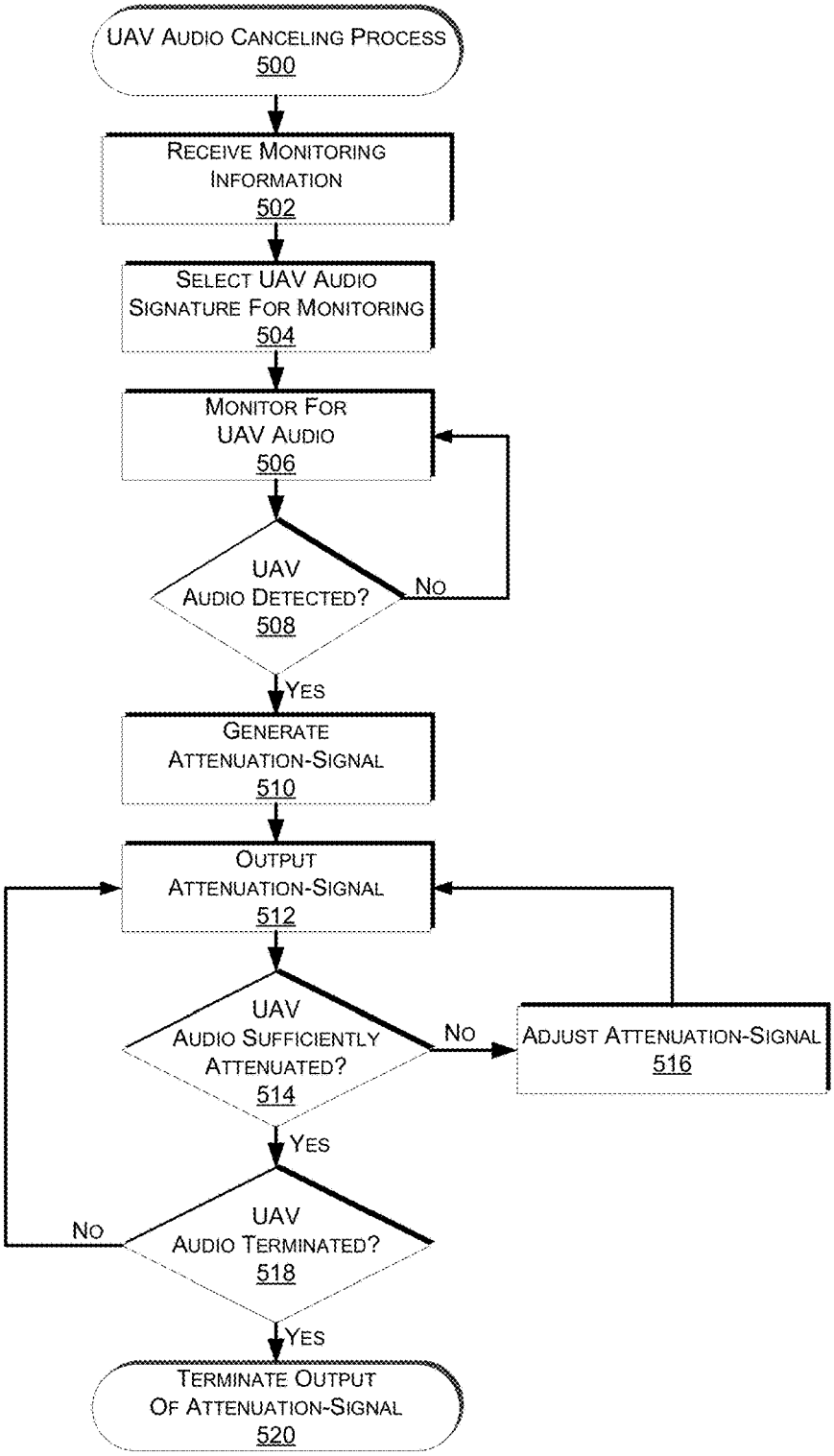
FIG. 5 is a flow diagram illustrating an example unmanned aerial vehicle audio canceling process, according to an implementation.

FIG. 5 is a flow diagram illustrating an example UAV audio canceling process 500, according to an implementation. The example process begins upon receipt of monitoring information by an audio canceling device, as in 502. The monitoring information indicates to the audio canceling device that monitoring for a UAV is to be performed. As discussed above, the monitoring information may be received from the UAV and/or from a remote-computing resource. In some implementations, the monitoring information may indicate a time or time period during which monitoring is to be performed.

In some implementations, the audio canceling device may select a UAV audio signature that is utilized to determine if UAV audio generated by a UAV is detected, as in 504. The audio signature may be included in the monitoring information and/or it may be stored by the UAV audio signature module 222 (FIG. 2) of the audio canceling device 109. If stored in the audio canceling device, the monitoring information may include an identifier of the UAV and/or the UAV audio signature that is to be selected for monitoring.

Utilizing the selected UAV audio signature, the audio canceling device monitors for UAV audio generated by the UAV, as in 506. For example, the audio canceling device may activate a transducer (e.g., microphone) and record audio from the environment in which the audio canceling device is located. The recorded audio may be compared with the selected UAV audio signature to determine whether there is an audio signal included in the recorded audio that is similar to the UAV audio signature. Similarity may be determined, for example, based on the frequency and/or amplitude of the audio signals.

A determination is then made as to whether UAV audio is detected in the recorded audio, as in 508. If it is determined that UAV audio is not detected, the example process 500 returns to block 506 and continues. However, if it is determined that UAV audio is detected, an attenuation-signal is generated based on the detected UAV audio, as in 510. As discussed above, an attenuation-signal may be generated by phase shifting and/or inverting the polarity of the detected UAV audio.

Upon generation of the attenuation-signal, the attenuation-signal is amplified to match the amplitude of the detected UAV audio and output on a sound wave from the output of the audio canceling device, as in 512. As discussed above, in some implementations, a canceling location may be determined and the output of the attenuation-signal may be timed so that, when output, it will arrive at the canceling location at approximately the same time as the UAV audio, thereby causing destructive interference with the UAV audio.

In other implementations, as illustrated in the example process 500, the attenuation-signal may be output without computing or using a time delay. Because the UAV audio generated by the UAV is fairly repetitive, the resultant audio generated based on the UAV audio and the output attenuation-signal may be monitored to determine if the UAV audio is sufficiently attenuated, as in 514. If the UAV audio is sufficiently attenuated, the output attenuation-signal is arriving at approximately a same time as the UAV audio and causing destructive interference that cancels out or reduces the UAV audio. In comparison, if it is determined that the UAV audio is not sufficiently attenuated, the attenuation-signal may be adjusted by further phase shifting, adjusting the polarity, altering the amplitude, and/or altering or delaying the time at which the attenuation-signal is sent from the output, as in 516. After adjusting the attenuation-signal, the example process returns to block 512 and continues.

If it is determined that the UAV audio is sufficiently attenuated, a determination is made as to whether the UAV audio has been terminated, as in 518. The UAV audio may be terminated if, for example, the UAV departs the area or navigates to a distance at which the audio cannot be detected by the audio canceling device, the UAV lands and powers down or reduces the speed of the motors of the UAV, etc.

If it is determined that the UAV audio has terminated, the attenuation-signal is likewise terminated and the example process 500 completes, as in 520. If it is determined that the UAV audio has not terminated, the example process returns to block 512 and continues the process of outputting the attenuation-signal, determining if the UAV audio is sufficiently attenuated, and adjusting the attenuation-signal as necessary to sufficiently attenuate the UAV audio.

While the example process 500 illustrates completion upon a determination that the UAV audio signal has terminated, in some implementations, if it is determined that the UAV audio signal has terminated, the example process 500 may return to block 506 and continue monitoring for UAV audio for a defined period of time, before completing. Such an implementation may be beneficial if the UAV lands and powers down the motors for a period of time but then powers back up the motors to depart. When the UAV powers back up the motors, the UAV audio will be detected by the example process 500 and attenuated. In some implementations, the UAV and/or the remote-computing may computing resources may communicate with the audio canceling device and provide an indication relating to the arrival of the UAV, item delivery, and/or departure of the UAV from the delivery location. In such an example, the example process may continue monitoring for UAV audio and/or attenuating detected UAV audio until a notification is received that the UAV has departed.

Likewise, it will be appreciated that the example process 500 may not result in a complete cancellation of the UAV audio. However, such UAV audio may be attenuated or reduced a sufficient amount by the implementations discussed herein. In some implementations, in addition to attenuating the UAV audio, the audio output device may also generate other audio (e.g., music) to further reduce any impact and/or disruption by the UAV audio.

Figure 6:
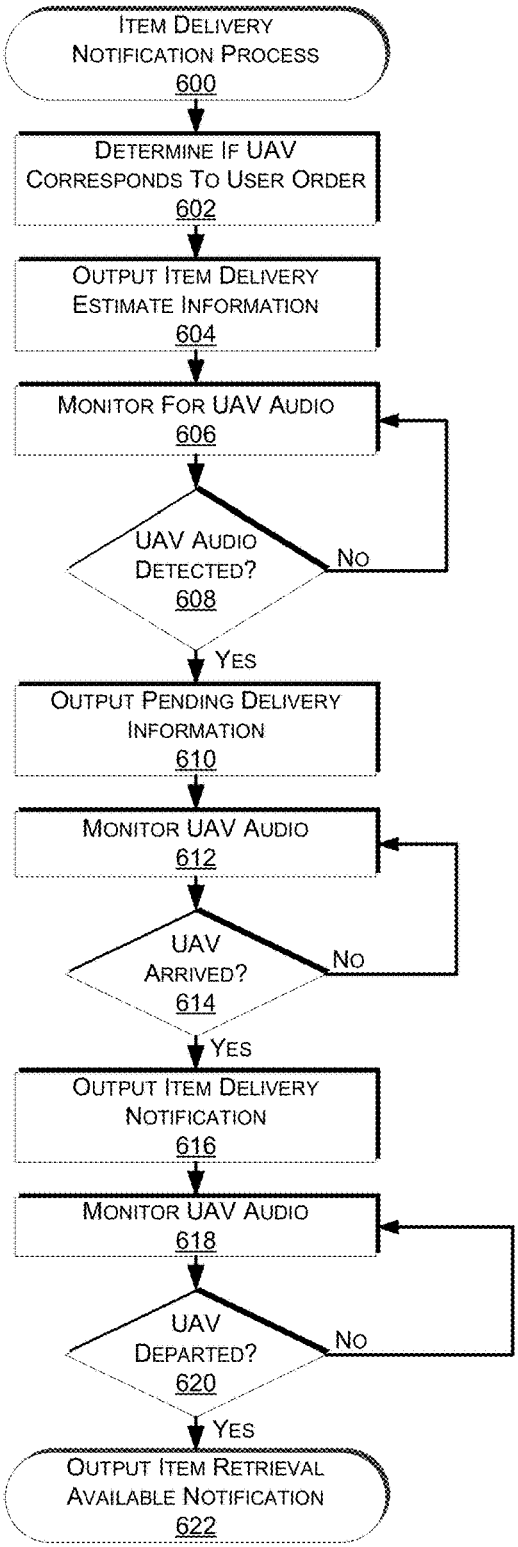
FIG. 6 is a flow diagram illustrating an example item delivery notification process, according to an implementation.

FIG. 6 is a flow diagram illustrating an example item delivery notification process 600, according to an implementation. The example process 600 begins by determining if a UAV that is to be within a defined distance of the audio canceling device is delivering an item, also referred to herein as a payload, ordered by a user associated with the audio canceling device, as in 602. As discussed above, the monitoring information may include, among other information, a flight plan for a UAV indicating a navigation path, a destination, and an approximate time at which the UAV will arrive at a destination. The monitoring information may also include a payload identifier or order identifier that identifies an order corresponding to a payload being carried by the UAV that will be delivered to the destination. Utilizing the delivery destination, payload identifier, and/or order identifier, the audio canceling device can determine if the UAV is carrying an item that will be delivered to the location of the audio canceling device. For example, the remote-computing resources may maintain information associating users and/or delivery destinations with audio canceling devices and, when a user associated with the audio canceling device orders an item for delivery to the destination, the remote-computing resources may provide the audio canceling device with an identifier that identifies the order, the payload, the UAV that will carry the ordered items, etc. Likewise, if another user, at any destination, orders an item for delivery to the destination associated with the audio canceling device, the remote-computing resources may provide order information, item information, and/or UAV identifier information to the audio canceling device.

If it is determined that the UAV will be delivering an item to the destination, the audio canceling device may audibly output item delivery estimate information, as in 604. The item delivery estimate information may indicate an estimated time of arrival for the item that will be delivered by the UAV, a planned delivery position at which the UAV is planning to deliver the item, etc. In some implementations, a user may provide information back to the audio canceling device relating to the order and/or delivery of the item. For example, the user may provide feedback altering the delivery destination, altering a position at the delivery destination for the planned delivery, altering a time of the delivery, etc. Likewise, if any activities need to be performed by the user in anticipation of the delivery, the audio canceling device may output a request that is sent from the remote-computing resources relating to the activity. For example, if the user is to position a landing identifier or marker at a desired delivery position at the delivery destination, the remote-computing resources may provide a request to the audio canceling device that is output to the user requesting that the user perform the activity prior to arrival of the UAV. If it is determined that the UAV is not delivering an item, for example, the UAV will just be passing by the location that includes the audio canceling device, the audio canceling device may perform the example process 500 (FIG. 5), and not provide any notifications(s) to a user.

In addition to outputting item delivery estimate information, the audio canceling device monitors UAV audio, as in 606. As discussed above, the monitoring information may include an audio signature associated with the UAV. The audio canceling device may monitor for the UAV by recording audio and processing the audio to determine if UAV audio from the UAV is detected, as in 608. Alternatively, as discussed above, the UAV may record audio and provide that audio to the remote-computing resources, and the remote-computing resources may process the audio to determine if UAV audio from the UAV is present in the audio.

If it is determined that UAV audio from the UAV is not detected, the example process 600 returns to block 606 and continues. If UAV audio is detected, pending delivery information is output by the audio canceling device, as in 610. In another implementation, the UAV and/or the remote-computing resources may send additional information to the audio canceling device that notifies the audio canceling device of the arrival of the UAV at the delivery destination. In such an implementation, the audio canceling device may output pending delivery information based on the additional information received from the UAV and/or the remote computing resources. Pending delivery information may include a notification that the UAV is approaching the delivery destination and/or an update as to when the UAV will arrive at the delivery destination.

The example process 600 continues monitoring for UAV audio from the UAV, as in 612, and determines, based at least in part on the UAV audio, whether the UAV has arrived at the delivery destination, as in 614. For example, in some implementations, the UAV may land at the delivery destination to complete delivery of the payload. In such an implementation, the UAV may power down the motors of the UAV, thereby resulting in a decrease in amplitude of the UAV audio from the UAV and/or a change in a frequency of the UAV audio from the UAV. In another example, if the UAV does not land but becomes stationary for a period of time while the payload is delivered, the audio canceling device, utilizing the audio transducer array, may determine that the UAV is within a distance of the delivery destination and is stationary, thereby indicating that the payload is being delivered to the delivery destination. In still another example, the UAV and/or remote-computing resource may provide a notification to the audio canceling device indicating that the UAV has arrived at the delivery destination.

If it is determined that the UAV has not yet arrived, the example process 600 returns to block 612 and continues to monitor the UAV audio generated by the UAV. If it is determined that the UAV has arrived, in addition to attenuating the UAV audio, as discussed above with respect to FIG. 5, the audio canceling device may output a notification that the UAV has arrived and the payload (item) is being delivered, as in 616. Such information, while informative to the user, also aids in reducing or masking the UAV audio generated by the UAV.

Finally, the example process 600 continues to monitor the UAV audio generated by the UAV, as in 618, to determine if the UAV has departed the delivery destination, as in 620. It may be determined that the UAV has departed the delivery destination as the UAV audio generated by the UAV decreases below a threshold level or is no longer detected by the audio canceling device. Alternatively, or in addition thereto, the UAV and/or the remote-computing resources may send additional information to the audio canceling device that notifies the audio canceling device of the UAVs departure from the delivery destination. If it is determined that the UAV has not departed the delivery destination, the example process 600 returns to block 618 and continues monitoring the UAV audio. If it is determined that the UAV has departed the delivery destination, output is provided by the audio canceling device indicating the delivery of the payload is complete and that the UAV has departed, as in 622.

By providing users with real-time audio updates from the audio canceling device relating to the UAV delivery of an ordered item, the users can perform any necessary activities in anticipation of the delivery and retrieve their ordered items immediately following delivery.

Figure 7:
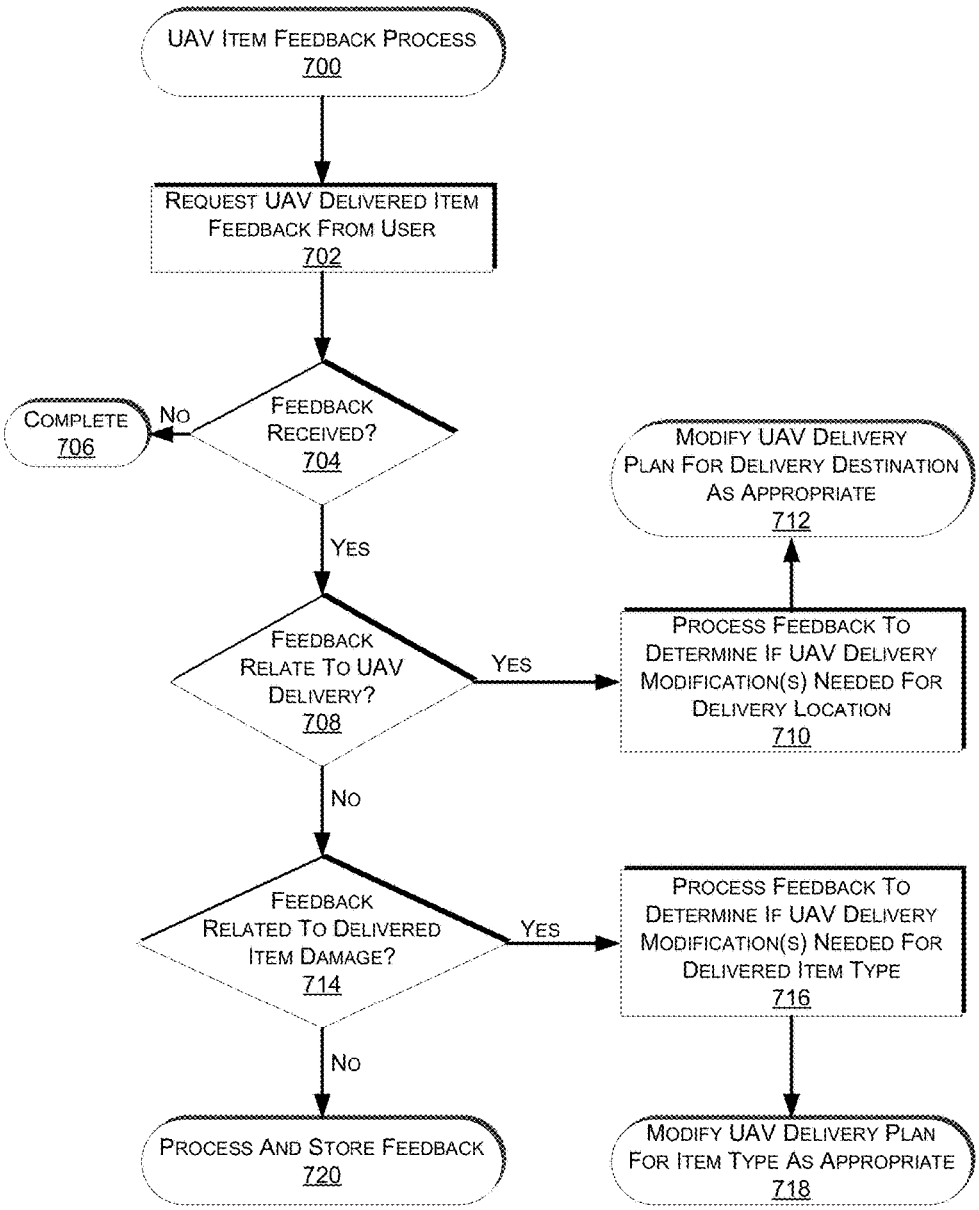
FIG. 7 is a flow diagram illustrating an example unmanned aerial vehicle item feedback process, according to an implementation.

FIG. 7 is a flow diagram illustrating an example unmanned aerial vehicle item feedback process 700, according to an implementation. After an item has been delivered by a UAV to a delivery destination, the audio canceling device may request UAV delivery item feedback from a user, as in 702. For example, the audio canceling device may output a request asking the user to provide feedback relating to the UAV delivery, the condition of the item, etc.

The example process then determines if feedback has been received, as in 704. If it is determined that feedback was not received, the example process 700 completes, as in 706. If feedback is received, the feedback may be recorded and provided to remote-computing resources for processing. In one example, the feedback may be processed to determine if the feedback relates to the UAV delivery, as in 708. If it is determined that the feedback relates to the UAV delivery, the feedback may be further processed to determine if any UAV delivery modifications are needed for that delivery location, as in 710. For example, the user may provide feedback indicating that the UAV landed too close to a table (or other object) when delivering an item to a position in the backyard of the delivery destination. Alternatively, the user may provide feedback that the UAV delivery was as expected.

Based on the processed feedback, any modifications that are needed for the delivery location may be updated and maintained by the remote-computing resources for future UAV deliveries to the delivery destination, as in 712. For example, if it is determined from the feedback that the UAV landed too close to an object, the landing position for the delivery destination may be updated to a different position within the backyard of the delivery destination and/or an indicator relating to the position of the object may be added to the delivery destination information.

Returning to decision block 708, if it is determined that the feedback does not relate to UAV delivery, a determination is made as to whether the feedback relates to delivered item damage, as in 714. For example, a user may provide feedback relating to the delivered item that indicates whether the delivered item and/or the container in which the item was delivered is damaged. If it is determined that the feedback relates to delivered item damage, the feedback is further processed to assess whether the damage may have occurred as part of the UAV delivery and, if so, whether delivery modifications are to be made for UAV deliveries for the delivered item type, as in 716. For example, the activities involved in the picking, packing, loading of the item onto the UAV, and the delivery of the item by the UAV may be analyzed to determine where the damaged occurred, whether other like items have been similarly damaged, etc. Any modifications to the UAV delivery plan for the item type are made and stored by the remote-computing resources for future orders and deliveries of the item, as in 718.

Finally, if it is determined that the feedback does not relate to the delivered item damage, the feedback is otherwise processed and stored, as in 720. For example, if the feedback relates to a review of the item, the feedback may be processed to determine that it relates to an item review, stored by the remote-computing resources, and associated with the item.

Although the subject matter has been described in language specific to structural features and methodologies, it is to be understood that the subject matter defined in the appended claims is not necessarily limited to the specific features described. Rather, the specific features are disclosed as illustrative forms of implementing the claims.

What is claimed is:

1. A method comprising:

under control of one or more computing devices configured with executable instructions, emitting, by an audio canceling device, information indicating a location of the audio canceling device;

responsive to the emitted information indicating the location of the audio canceling device, receiving, at the audio canceling device, monitoring information indicating that an unmanned aerial vehicle ("UAV") will be within a defined distance of the audio canceling device, the monitoring information including a UAV audio signature representative of audio generated by the UAV;

recording an audio signal from an environment in which the audio canceling device is located;

processing the audio signal to determine a portion of the audio signal that corresponds to the UAV audio signature;

determining, based at least in part on the audio signal, that the UAV is approaching the location of the audio canceling device;

outputting from an output of the audio canceling device an audible notification that the UAV is approaching;

generating an attenuation-signal based at least in part on the portion of the audio signal, wherein the attenuation-signal is generated by at least phase shifting the audio signal; and outputting the attenuation-signal from the output of the audio canceling device so that the portion of the audio signal is attenuated by the attenuation-signal within at least a portion of the environment;

wherein the audible notification that the UAV is approaching that is output from the audio canceling device is distinct from the attenuation-signal based at least in part on the portion of the audio signal that is output from the audio canceling device.

2. The method as recited in claim 1, wherein processing the audio signal includes:

comparing at least one of a frequency or an amplitude of the audio signal with the UAV audio signature.

3. The method as recited in claim 1, further comprising:

determining a time delay that is to elapse before the attenuation-signal is sent from the output so that the attenuation-signal will arrive at a canceling location within the environment such that the portion of the audio signal is attenuated by the attenuation-signal at the canceling location.

4. An apparatus, comprising:
a transducer to receive audio signals;
an output to generate output audio signals;
a wireless unit that communicates with an unmanned aerial vehicle ("UAV") and receives monitoring information;
a processor; and
a computer-readable media storing computer-executable instructions that, when executed by the processor, cause the processor to at least:
emit, from the wireless unit, information indicating a location of the apparatus;
responsive to the emitted information indicating the location of the apparatus, receive, by the wireless unit, the monitoring information;
receive from the transducer, UAV audio generated by a UAV that is within a distance of the apparatus;
generate an attenuation-signal based at least in part on the UAV audio, wherein the attenuation-signal is generated by at least phase shifting the UAV audio;
cause the output to output an audible notification that the UAV is within the distance of the apparatus; and
cause the output to output the attenuation-signal so that the attenuation-signal will attenuate the UAV audio;
wherein the audible notification that the UAV is within the distance of the apparatus is distinct from the attenuation-signal based at least in part on the UAV audio.

5. The apparatus of claim 4, wherein the computer-executable instructions, when executed by the processor, further cause the processor to at least:
determine a position of a user; and
cause the output to output the attenuation-signal so that the attenuation-signal will arrive at the position of the user and attenuate the UAV audio at the position of the user.

6. The apparatus of claim 5, wherein the computer-executable instructions, when executed by the processor, further cause the processor to at least:
determine a remaining time before the UAV audio arrives at the position of the user;
determine a required time for the attenuation-signal to travel from the output to the position of the user;
determine a time delay as a difference between the remaining time and the required time; and
cause the output to output the attenuation-signal after the time delay has elapsed.

7. The apparatus of claim 4, wherein the computer-executable instructions, when executed by the processor, further cause the processor to at least:
determine, based at least in part on the UAV audio, that the UAV has arrived at a delivery destination; and
cause the output to output a notification that the UAV has arrived at the delivery destination;
wherein the notification that the UAV has arrived at the delivery destination is distinct from the attenuation-signal based at least in part on the UAV audio.

8. The apparatus of claim 4, wherein the computer-executable instructions, when executed by the processor, further cause the processor to at least:
determine, based at least in part on the UAV audio, that the UAV has departed a delivery destination; and
cause the output to output a notification that delivery of an item has completed and that the UAV has departed the delivery destination;
wherein the notification that the delivery of the item has completed and that the UAV has departed the delivery destination is distinct from the attenuation-signal based at least in part on the UAV audio.

9. The apparatus of claim 4, wherein the computer-executable instructions, when executed by the processor, further cause the processor to at least:
determine that a feedback has been received from a user; and
send the feedback to a remote-computing resource for processing and storage.

10. The apparatus of claim 4, wherein the wireless unit receives the monitoring information from the UAV, the monitoring information indicating a flight path of the UAV.

11. The apparatus of claim 4, wherein the wireless unit further communicates with a remote-computing resource and receives the monitoring information from the remote-computing resource, the monitoring information indicating a flight path of the UAV.

12. The apparatus of claim 4, wherein the computer-executable instructions, when executed by the processor, further cause the processor to at least:
receive from the transducer a resultant audio after the output has output the attenuation-signal; and
process the resultant audio to determine that the UAV audio has been sufficiently attenuated.

13. The apparatus of claim 4, wherein the attenuation-signal is further generated by inverting a polarity of the UAV audio.

14. The apparatus of claim 4, wherein the computer-executable instructions, when executed by the processor, further cause the processor to at least:
receive from the transducer a resultant audio after the output has output the attenuation-signal;
process the resultant audio to determine that the UAV audio has not been sufficiently attenuated;
alter the attenuation-signal; and
cause the output to output the altered attenuation-signal.

15. A computer-implemented method, comprising:
emitting, by an audio canceling device, information indicating a location of the audio canceling device;
responsive to the emitted information indicating the location of the audio canceling device, receiving, at the audio canceling device, monitoring information corresponding to an aerial vehicle being within a defined distance of the audio canceling device;
in response to receiving the monitoring information, monitoring, with the audio canceling device, audio;
determining that the audio includes audio generated by the aerial vehicle;
outputting from the audio canceling device an audible notification that the aerial vehicle is within the defined distance;
generating, based at least in part on the audio generated by the aerial vehicle, an attenuation-signal by at least phase shifting at least a portion of the audio; and
outputting from the audio canceling device the attenuation-signal such that the attenuation-signal attenuates the audio generated by the aerial vehicle;
wherein the audible notification that the aerial vehicle is within the defined distance is distinct from the attenuation-signal based at least in part on the audio generated by the aerial vehicle.

16. The computer-implemented method of claim 15, wherein the monitoring information includes an aerial vehicle audio signature representative of audio generated by the aerial vehicle.

17. The computer-implemented method of claim 16, wherein:

the monitoring includes comparing the audio with the aerial vehicle signature to determine the at least a portion of the audio that is similar to the aerial vehicle signature; and the generating the attenuation-signal further includes inverting a polarity of the at least a portion of the audio.

18. The computer-implemented method of claim 17, further comprising:

adjusting an amplitude of the attenuation-signal based at least in part on an amplitude of the at least a portion of the audio.

19. The computer-implemented method of claim 15, wherein:

the monitoring information further includes a time indicator representative of a time during which the aerial vehicle is anticipated to be within the defined distance of the audio canceling device; and the monitoring is initiated based on the time indicator.

* * * * *